US006053854A

United States Patent [19]

Ynag

[11] Patent Number: 6,053,854

[45] Date of Patent: Apr. 25, 2000

[54] APPARATUS FOR FORMING A CONTAINER OR BOX FROM A BLANK

[76] Inventor: Shun-Yu Ynag, No. 84, Pei-Chuang Rd., Sheng-Kang Hsiang, Taichung Hsien, Taiwan

[21] Appl. No.: 09/167,233

[22] Filed: Oct. 6, 1998

[51] Int. Cl.[7] ..... B31B 1/44

[52] U.S. Cl. ..... 493/167; 493/143

[58] Field of Search ..... 493/167, 148, 493/149, 152, 153, 177, 178, 180, 143, 142, 140, 130, 133; 53/456, 563, 223, 231, 230

[56] References Cited

U.S. PATENT DOCUMENTS

| | | | |
|---|---|---|---|
| 4,173,173 | 11/1979 | Mims | 493/167 |
| 4,936,815 | 6/1990 | Kirkland et al. | 493/167 |
| 5,193,328 | 3/1993 | Boriani et al. | 493/167 |
| 5,873,220 | 2/1999 | Haraldsson et al. | 53/411 |

*Primary Examiner*—John Sipos
*Assistant Examiner*—Steven Jensen
*Attorney, Agent, or Firm*—Harness, Dickey & Pierce, P.L.C.

[57] ABSTRACT

An apparatus is used to form a container from a blank which has innermost fold lines that confine a closed bottom of the container, and outer fold lines that extend outwardly from four corners of the bottom. The apparatus includes a blank forming device which defines a forming passage of polygonal cross-section and having four corners. A blank feeding device is adapted to feed the blank towards the blank forming device in a first direction substantially parallel to the cross-section of the forming passage. A punching mechanism has a punch head of polygonal cross-section and capable of passing through the forming passage in a second direction transverse to the first direction. The punch head has a forward end formed with a polygonal push pad for pushing the blank through the forming passage. The blank forming device has a pair of first folding parts and a pair of second folding parts which confine the forming passage and which are adapted to fold the blank about the innermost fold lines when the punch head pushes the blank through the forming passage in the second direction. The first and second folding parts are spaced apart from each other adjacent to the corners of the forming passage.

12 Claims, 14 Drawing Sheets

APPARATUS FOR FORMING A CONTAINER OR BOX FROM A BLANK

BACKGROUND OF THE INVENTION

1. Field of the invention

The present invention relates to an apparatus for forming a container or box from a blank, more particularly to an apparatus for forming a container or box by folding a blank about pre-formed fold lines individually and successively.

2. Description of the Related Art

Referring to FIGS. 1 and 2, a container or box is formed from a blank 200 provided with fold lines including interconnected innermost fold lines 203 that confine a substantially closed bottom of polygonal shape and having at least four corners, and outer fold lines 202 that extend outwardly from the corners. Since the blank 200 is provided with two PE coating layers at two opposite sides thereof, the blank 200 is manually folded about the innermost fold lines 203 to form the closed bottom 200B of the container and then about the outer fold lines 202 to form side walls 200S and flaps 200F. The flaps 200F can then be folded under high pressure and heat, where the PE coating layers serve as a binder for binding the flaps 200F on the side walls 200S.

It is time-consuming and laborious to manually fold the blank 200 into a box. A relatively high manufacturing cost is thus incurred.

SUMMARY OF THE INVENTION

An object of the invention is to provide an apparatus for forming containers from blanks, which enables blanks to be formed mechanically into containers via a continuous process, thereby reducing labor and increasing the rate of production.

Accordingly, an apparatus of this invention is adapted to form a container from a blank which is provided with fold lines including interconnected innermost fold lines that confine a substantially central region of polygonal shape having at least four corners, and outer fold lines that extend outwardly from the corners. The blank is foldable about the innermost fold lines to form a closed bottom of the container, and about the outer fold lines to form side walls and flaps which project outwardly of the side walls. The apparatus includes a blank forming device, a blank feeding device and a punching mechanism. The blank forming device includes a forming passage of substantially polygonal cross-section, and having at least four corners. The blank feeding device is disposed adjacent to the blank forming device and is adapted to feed the blank towards the blank forming device in a first direction substantially parallel to the cross-section of the forming passage. The punching mechanism is disposed adjacent to the blank forming device, and has a punch head of polygonal cross-section. The punch head is capable of passing through the forming passage in a second direction transverse to the first direction, and has a forward end formed with a polygonal push pad that is adapted to push the central region of the blank through the forming passage. The blank forming device has a pair of opposing first folding parts and a pair of opposing second folding parts which confine the forming passage and which are adapted to fold the blank about the innermost fold lines when the punch head pushes the central region of the blank through the forming passage in the second direction. The first and second folding parts are spaced apart from each other adjacent to the corners of the forming passage, thereby forming discontinuations adjacent to the corners of the forming passage to permit the flaps to project outwardly of the forming passage. The blank forming device further has a pair of spaced apart first flap folding members and a pair of spaced apart second flap folding members, all of which are disposed downstream of the first and second folding parts relative to the second direction of the punch head to confine a first downstream path for the punch head after the punch head exits the forming passage. The first flap folding members are disposed at two opposite sides of the first downstream path, and are adapted to fold two of the flaps about the corresponding outer fold lines. The second flap folding members extend at the two opposite sides of the first downstream path, but project in opposite directions with respect to the first flap folding members. The second flap folding members are adapted to fold another two of the flaps subsequently.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 3:
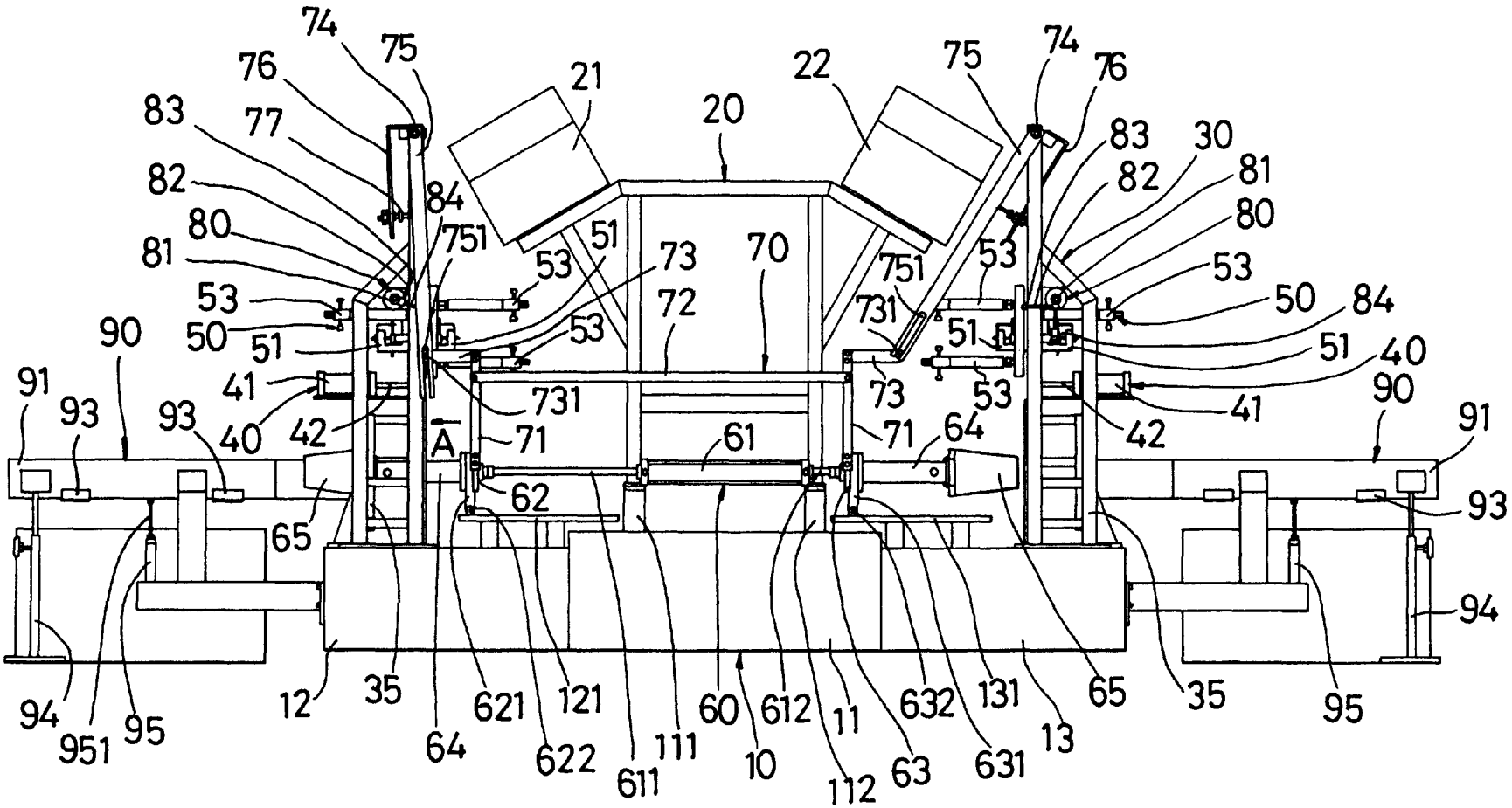
FIG. 3 is a schematic front elevation view of an apparatus embodying the present invention.
Figure 4:
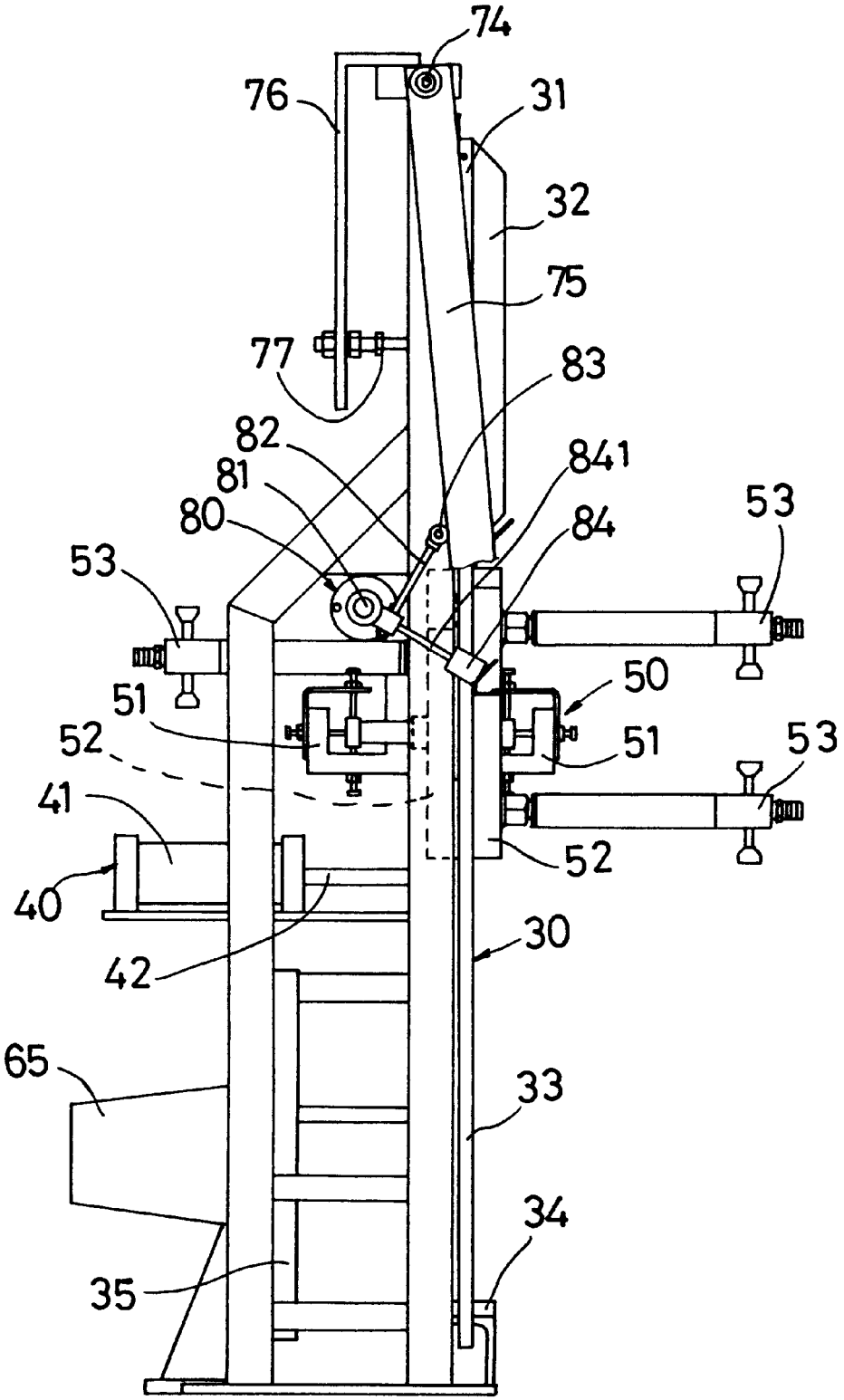
FIG. 4 is a fragmentary front elevation view showing a blank feeding and forming frame of the apparatus of FIG. 3.
Figure 5:
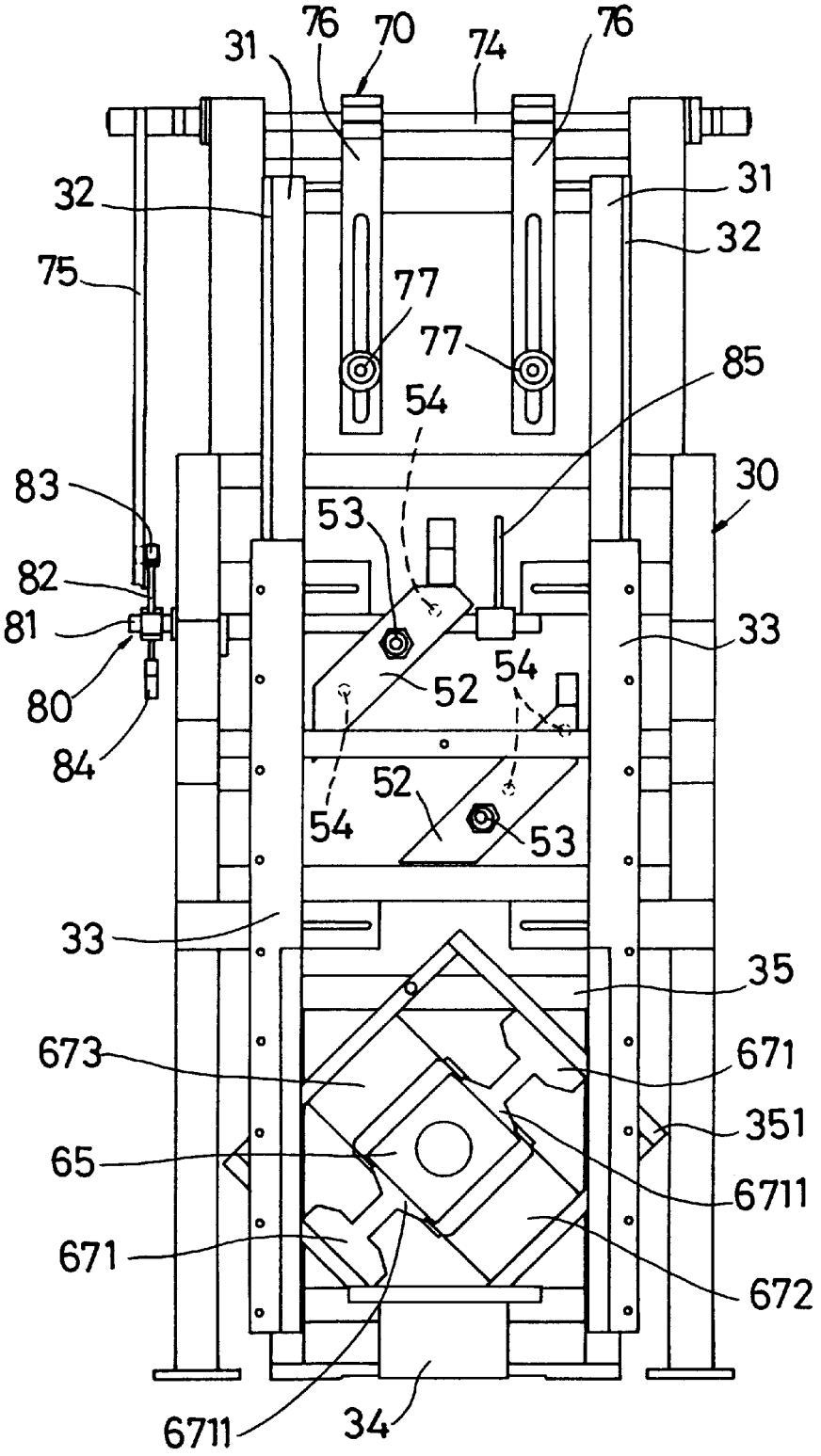
FIG. 5 is a fragmentary elevation view of the blank feeding and forming frame as viewed in a direction indicated by arrow A in FIG. 3.

Referring to FIGS. 3, 4 and 5, an apparatus for forming a container embodying the present invention is shown to include a base support 10, a blank holding frame 20, two blank feeding and forming frames 30, two temporary stop mechanisms 40, two heating devices 50, a power-operated drive mechanism 60, and two blank transporting mechanisms 70.

The base support 10 includes an intermediate support member 11 and two symmetrically disposed left and right support members 12, 13. Two bridge seats 111, 112 are mounted to the intermediate support member 11. Two sets of support rails 121, 131 are mounted to the left and right support members 12, 13, respectively.

The blank holding frame 20 is mounted on the bridge seats 111, 112. On two sides of the blank holding frame 20, there are left and right downwardly inclining blank guide plate units 21, 22 for holding blanks (not shown).

The left and right blank feeding and forming frames 30 are mounted respectively on the left and right support members 12, 13. Each of the blank feeding and forming frame 30 includes a pair of spaced apart upstanding blank feeding rail members 31 to receive each blank therebetween and transfer the same downward by virtue of gravity. Two side flanges 32 project, respectively, from the outer sides of the upstanding blank feeding rail members 31 to limit each blank therebetween when the blank slides downward therealong. Cover plates 33 are disposed to confront with and cover the upstanding blank feeding rail members 31 so that the blank drops between the upstanding blank feeding rail members 31 and the cover plates 33. A blank resting seat 34 is provided at the bottom end of the upstanding blank feeding rail members 31.

The temporary stop mechanisms 40 are mounted respectively on the blank feeding and forming frames 30 adjacent to the top sides of the upstanding blank feeding rail members 31. Each temporary stop mechanism 40 includes a pneumatic cylinder 41 which operates a stop rod 42 so that the stop rod 42 can extend between the upstanding blank feeding rail members 31 to stop the blank temporarily thereat.

The heating devices 50 are also mounted respectively on the blank feeding and forming frames 30 above the corresponding stop mechanisms 40. L-shaped brackets 51 are fixedly attached to each blank feeding and forming frame 30 to hold each heating device 50 which is used to preheat the blank. Each heating device 50 has hot air outlet members 52 which are formed as flat and hollow members and which are arranged at two sides of the path along which the blank slides so that the blank has its two sides preheated before being fed to a blank forming device 67 which will be described hereinunder. The blank to be processed by the apparatus in this embodiment includes a paper sheet and two PE coating layers formed on two sides of the paper sheet. When the blank is heated by each heating device 50, the PE coating layers are softened so that, when the blank is folded under pressure, the PE coating layers serve as a binder for binding together the folded parts of the blank. Each hot air outlet member 52 is connected to a hot air supply pipe 53 and is provided with a plurality of air outlet apertures 54.

Figure 4A:
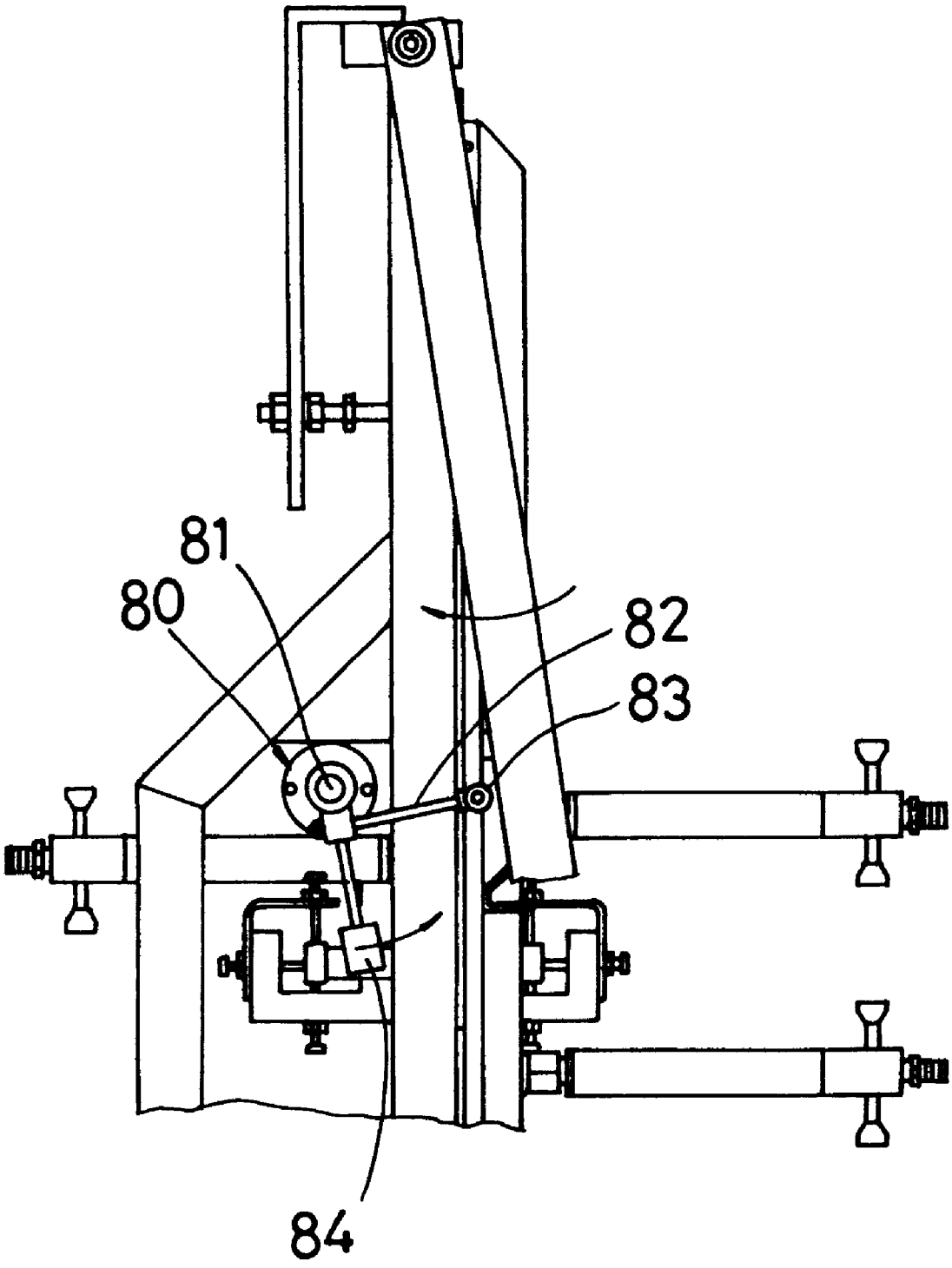
FIG. 4A is a fragmentary view similar to FIG. 4 with a portion of the blank feeding and forming frame being omitted, wherein a weight member is illustrated in its lower position.

The apparatus of this embodiment further includes two blank pushing mechanisms 80 which are mounted respectively on the left and right blank feeding and forming frames 30 adjacent to the heating devices 50. As best shown in FIG. 4, each blank pushing mechanism 80 includes a rotary shaft 81 which is mounted rotatably and horizontally on one of the blank feeding and forming frames 30. The rotary shaft 81 has an end portion that projects outwardly from one side of the corresponding blank feeding and forming frame 30. The end portion of the rotary shaft 81 is connected to a driven rod 82 which extends radially from the rotary shaft 81 and which has a contact block 83 at the end thereof. A weight arm 841 extends radially from the rotary shaft 81 and is spaced angularly from the driven rod 82. A weight member 84 is connected to the end of the weight arm 841. The rotary shaft 81 further extends to a location adjacent to the path of the blank to hold a blank pushing rod 85, as best shown in FIG. 5. Normally, the weight member 84 is at a lower position due to its weight, as shown in FIG. 4A, and can be turned upward to the position shown in FIG. 4 when the driven rod 82 is pushed by a swing arm 75 which will be described hereinbelow.

Figure 6:
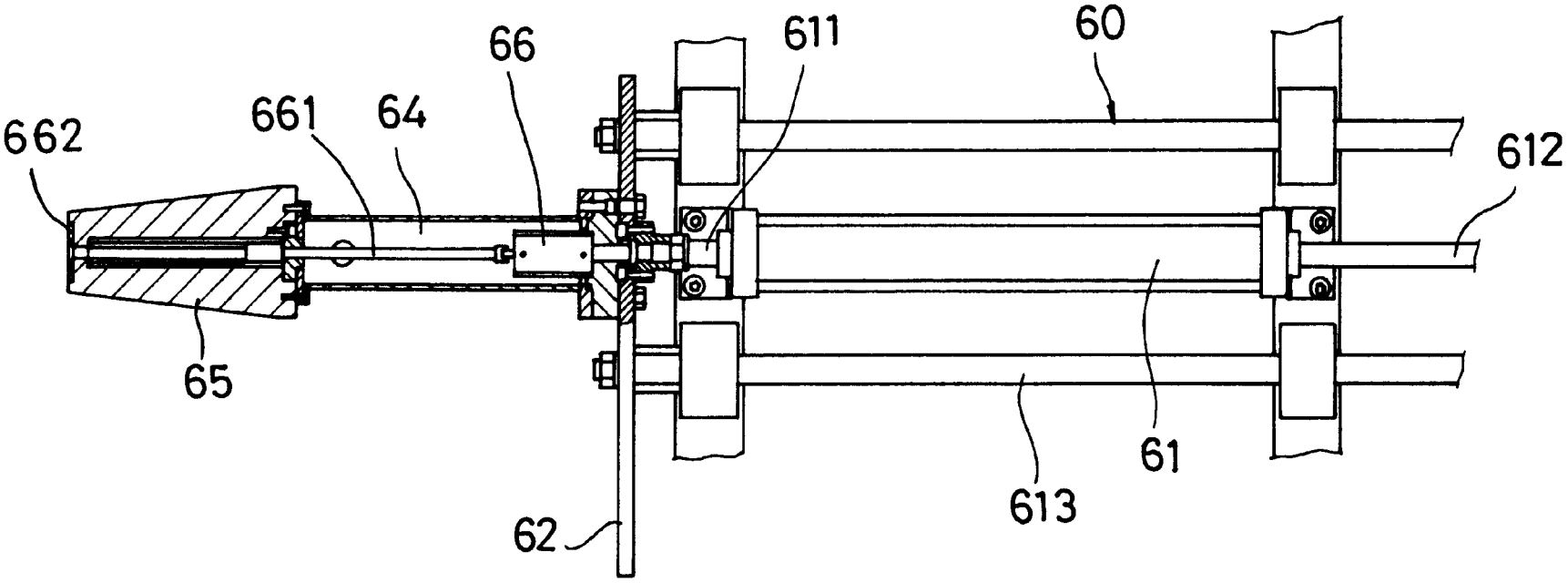
FIG. 6 is a fragmentary elevation view showing in more detail the power-operated drive mechanism and the punching mechanism of the apparatus.

Referring to FIG. 6, in combination with FIG. 3, the power-operated drive mechanism 60 includes a double-acting hydraulic cylinder 61 which is mounted on the bridge seats 111, 112 in a bridging manner. The hydraulic cylinder 61 has two piston rods 611 and 612 connected to punch guiding plates 62, 63 respectively. The punch guide plates 62, 63 are interconnected by a plurality of guide rods 613. Two punch heads 65 are, respectively, mounted on the punch guide plates 62, 63 via hollow punch head holders 64 at the other sides of the punch guide plates 62, 63 relative to the guide rods 613. The punch guide plates 62, 63 are mounted on wheeled legs 621, 631 which travel along the support rails 121, 131 provided in the left and right base seats 12, 13. The bottom ends of the wheeled legs 621, 631 are provided with wheels 622, 632 to roll along the support rails 121, 131. A pneumatic cylinder 66 is mounted inside each punch head holder 64, and has a plunger 661 connected to the corresponding punch head 65. Each punch head 65 is rectangular in cross-section and is tapered toward an end formed with a rectangular push pad 662.

Figure 7:
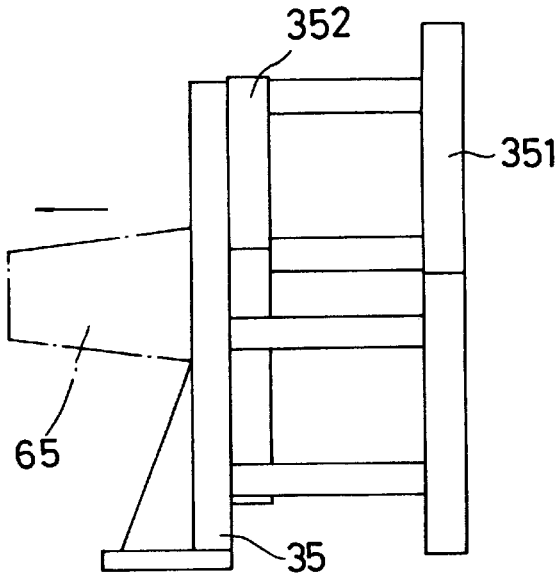
FIG. 7 is a fragmentary view which shows the frame to mount the blank forming device of the apparatus.
Figure 8:
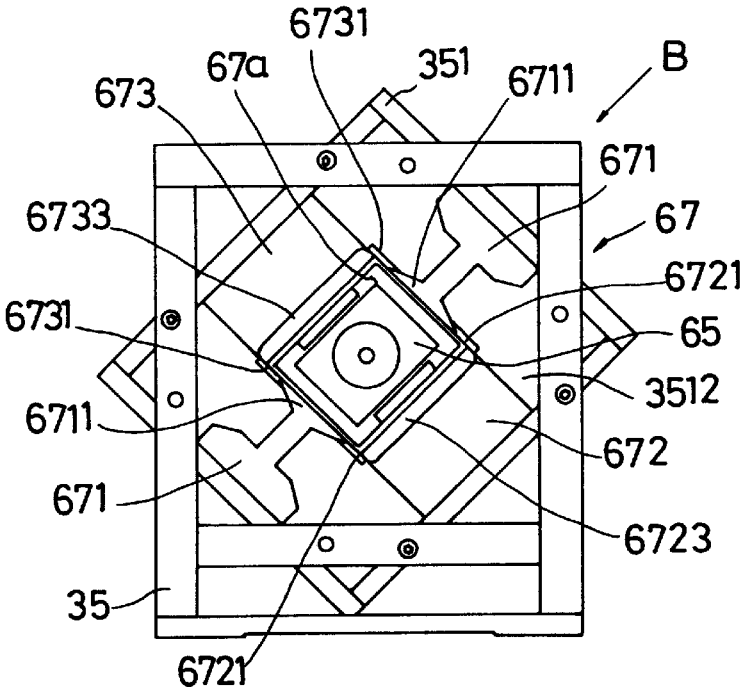
FIG. 8 is a fragmentary view showing the blank forming device.
Figure 9:
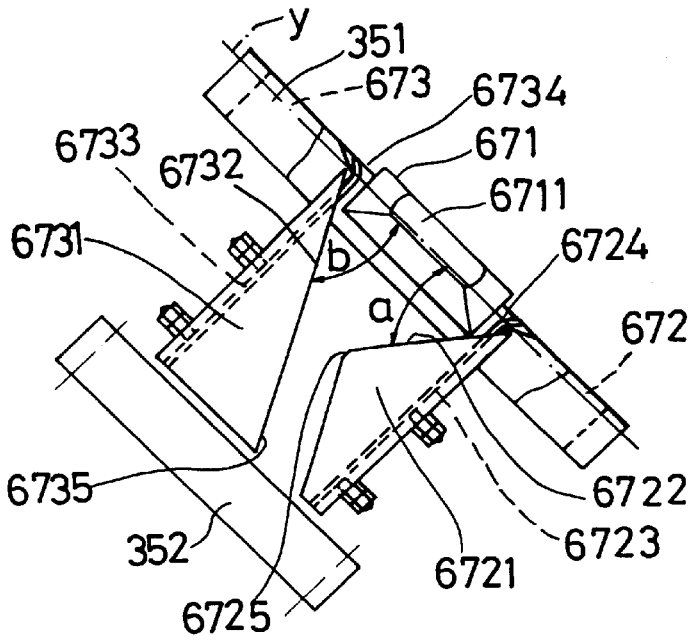
FIG. 9 is a fragmentary view of the blank forming device as viewed in a direction indicated by arrow B in FIG. 8.
Figure 10:
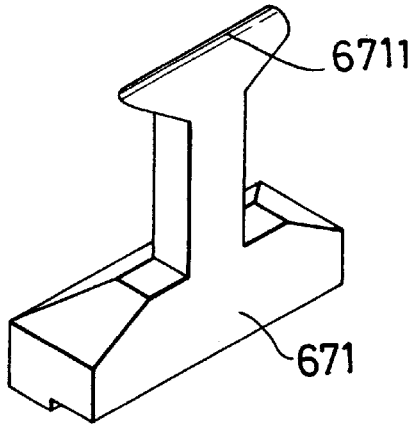
FIG. 10 is a perspective view of a first folding part of the blank forming device.
Figure 11:
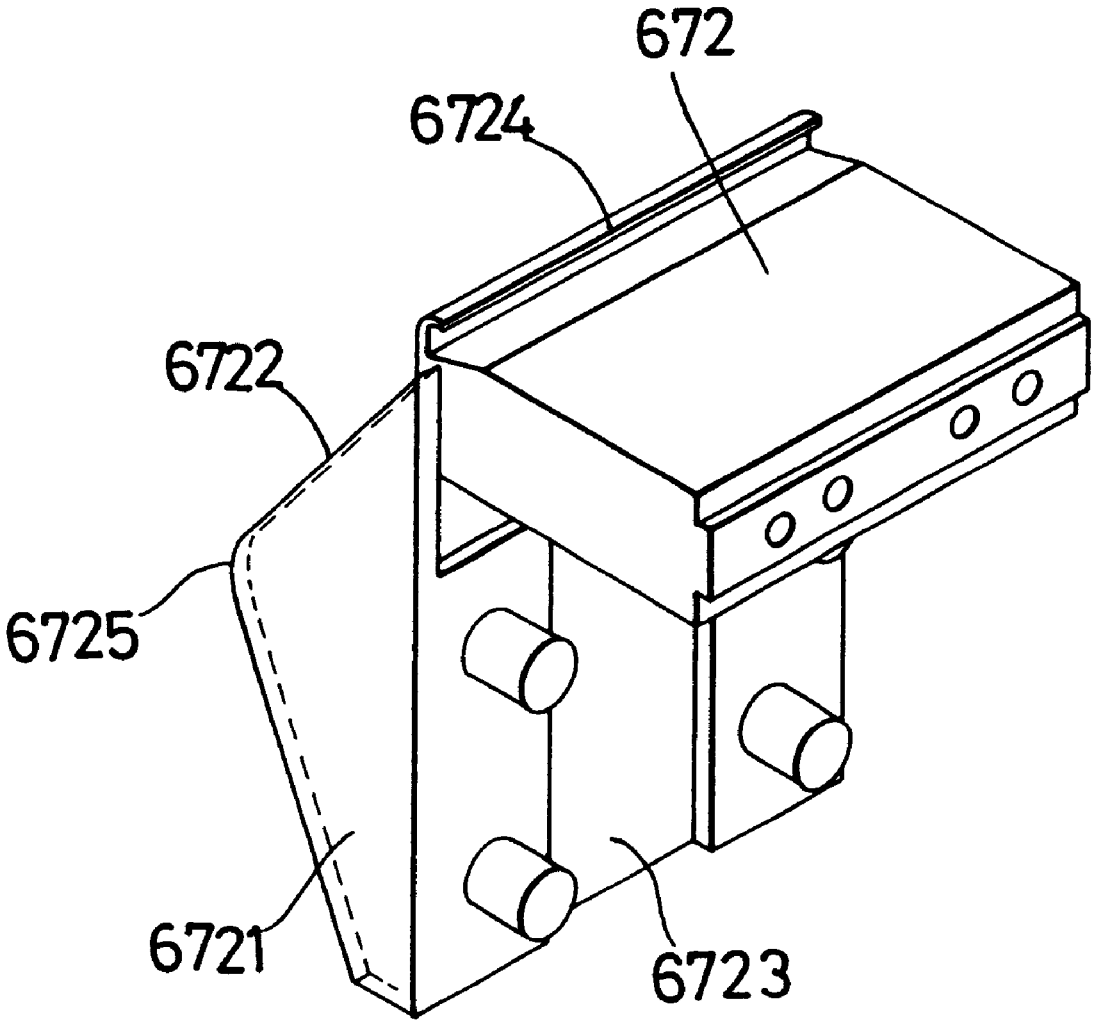
FIGS. 11 and 12 are perspective views of second folding parts of the blank forming device.
Figure 12:
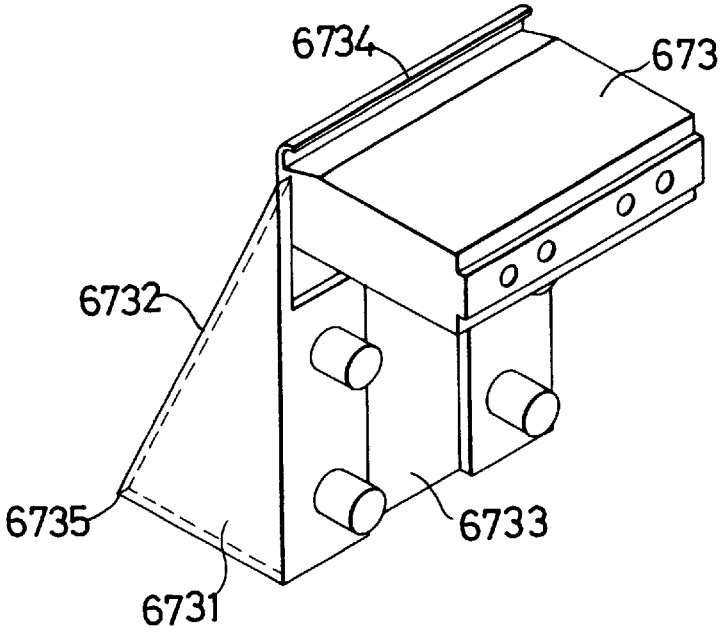

Referring to FIGS. 7 and 8, in combination with FIGS. 3 and 5, each blank feeding and forming frame 30 has a frame 35 adjacent to the bottom ends of the blank feeding rail members 31. A forming and guiding frame 351 and a press roller frame 352 are mounted on the frame 35. The forming and guiding frame 351 is a rectangular frame and confines a rectangular hole 3512. A blank forming device 67 is mounted on the forming and guiding frame 351 in an orientation that matches the moving path of each punch head 65.

Referring to FIGS. 9, 10, 11 and 12, in combination with FIG. 8, the blank forming device 67 includes a pair of opposing first folding parts 671 and a pair of opposing second folding parts 672, 673 to confine a forming passage 67*a* within the rectangular hole 3512. The forming passage 67*a* is substantially rectangular and permits the punch head 65 to pass therethrough during a forming operation. The first folding parts 671 are mounted on two opposite sides of the forming and guiding frame 351 to extend into the rectangular hole 3512. The second folding parts 672, 673 are mounted on the other two opposite sides of the forming and guiding frame 351 to extend into the rectangular hole 3512. The first and second folding parts 671, 672, 673 have anterior and posterior folding ends 6711, 6724, 6734 that confine the forming passage 67*a*. The posterior folding ends 6724, 6734 have opposite ends extending to the corners of the forming passage 67*a*. The anterior folding ends 6711 have opposite ends spaced from the corners of the forming passage 67*a*. As a result, the anterior and posterior folding ends 6711, 6724, 6734 are spaced apart from one another adjacent to the corners of the forming passage 67*a*, thereby forming discontinuations adjacent to the four corners of the forming passage 67*a*.

The anterior and posterior folding ends 6711, 6724, 6734 have a common plane (Y) that extends across the forming passage 67*a*. The anterior folding ends 6711 project from the common plane (Y) in directions opposite to the forward pushing direction of the punch head 65 so that the punch head 65 reaches the posterior folding ends 6724, 6734 after passing the anterior folding ends 6711.

The second folding parts 672, 673 further have integral projecting plate portions 6723, 6733 which project from the corresponding second folding parts in directions parallel to the forward pushing direction of the punch head 65, thereby confining a first downstream path for the punch head 65 to travel after exiting the forming passage 67*a*. First and second flap folding members 6721, 6731 are in the form of spaced apart parallel plates and project from the projecting plate portions 6723, 6733. The first and second flap folding members 6721, 6731 have first and second camming edges 6722, 6732 which project from the projecting plate portions 6723, 6733 adjacent to the common plane (Y). The first and second camming edges 6722, 6732 extend gradually away from the common plane (Y), as they project away from the projecting plate portions 6723, 6733, thereby forming first and second inclining angles (a), (b) respectively with the common plane (Y). The second inclining angles b are greater than the first inclining angles a so that the second flap folding members 6731 perform a flap folding action after the folding action of the first flap folding members 6721. The first and second flap folding members 6721, 6731 are substantially triangular and have distal apexes 6725, 6735 opposite the projecting plate portions 6723, 6733. The distal apexes 6725 are formed at the upstream sides of the distal apexes 6735.

Figure 13:
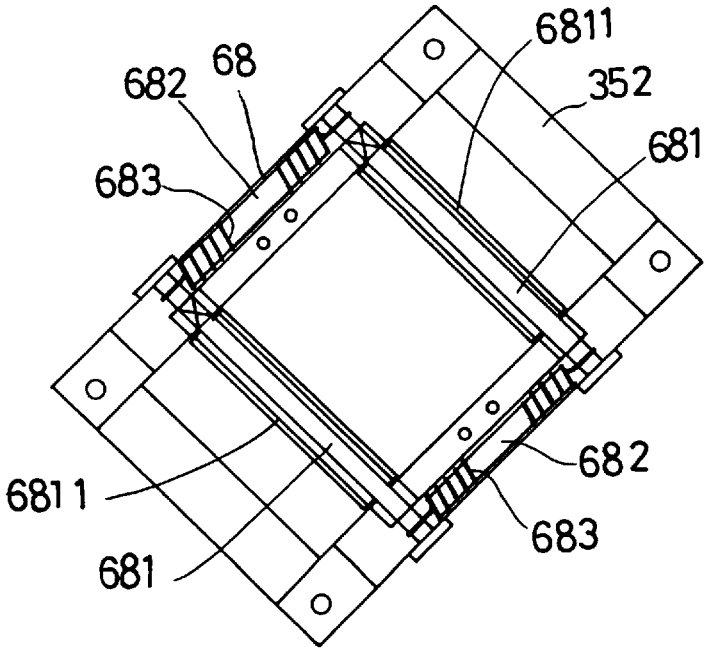
FIG. 13 is a schematic plan view showing the press roller assembly of the apparatus.

Referring to FIG. 13 in combination with FIG. 7, a press roller assembly 68 is mounted to the press roller frame 352 adjacent to the first and second flap folding members 6721, 6731. The press roller assembly 68 includes a pair of opposing press rollers 6811 which have substantially parallel roller shafts 681 that are biased by extension springs 683 in opposite directions and that are spaced apart by two spacer bars 682. The press rollers 6811 confine therebetween a second downstream path for the punch head 65 to travel after passing the first and second flap folding members 6721, 6731. When the tapered punch head 65 reaches the press rollers 6811, it pushes the press rollers 6811 against the biasing actions of the springs 683 so as to pass therethrough. As such, the punch head 65 passes the press rollers 6811 under pressure.

Referring again to FIGS. 3, 4 and 5, the two blank transporting mechanisms 70 include main drive arms 71 which are connected to the punch guide plates 62, 63 respectively and which are interconnected by a connecting bar 72. Each main drive arm 71 is connected to a connecting plate 73. A support shaft 74 is mounted horizontally on the top of each blank feeding and forming frame 30. A swing arm 75 is pivotally connected to the support shaft 74 and is provided with a slide groove 751. Slide rollers 731 attached to one end of the connecting plate 73 are slidably disposed in the slide groove 751, thereby connecting the connecting plate 73 to the swing arm 75. The support shaft 74 further supports two suction cup holding arms 76 which hold suction cups 77 used to transfer and deliver the blanks.

Figure 14:
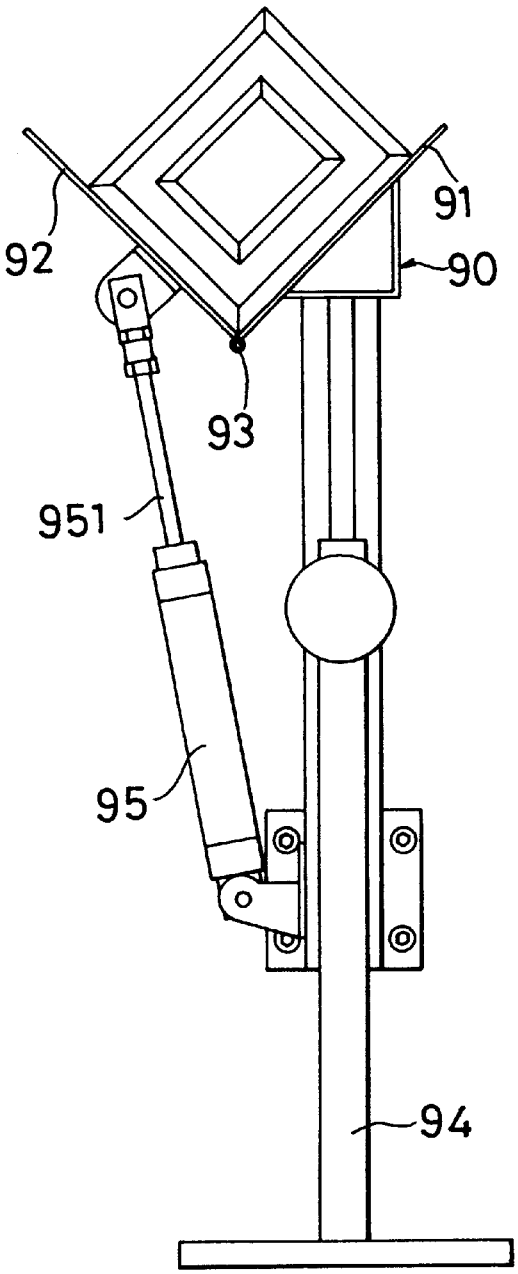
FIG. 14 is a fragmentary view showing a product collecting trough of the apparatus in a closed state.
Figure 15:
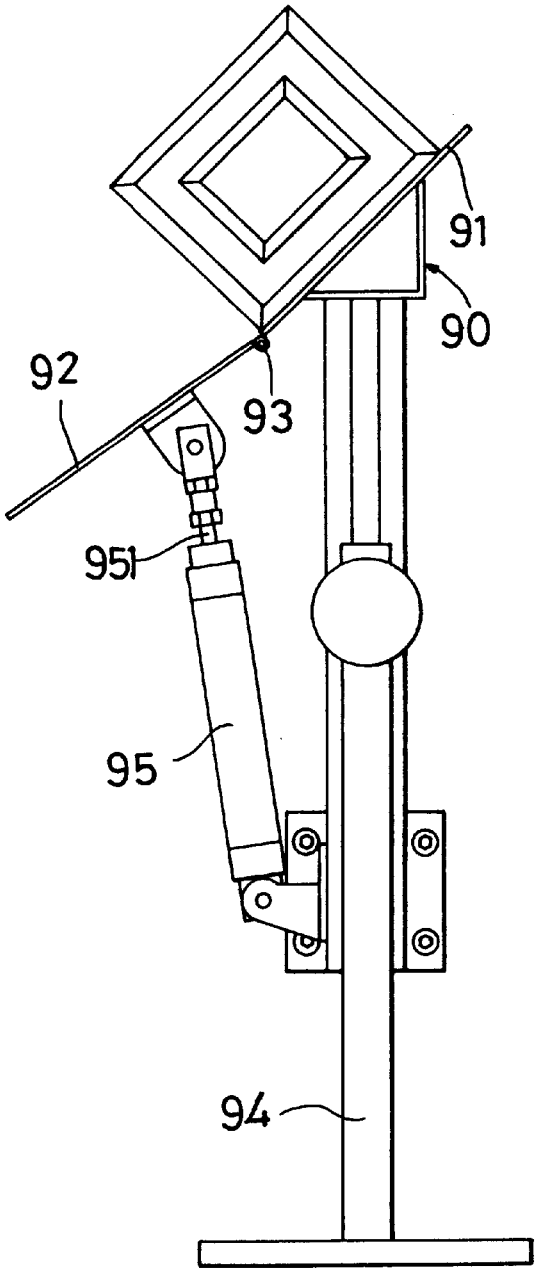
FIG. 15 is a view similar to that of FIG. 14 but showing the product collecting trough in an opened state.

Referring to FIGS. 14 and 15 in combination with FIG. 3, a product collecting trough 90 is provided adjacent to each blank feeding and forming frame 30 and is arranged to extend along the forward pushing direction of the corresponding punch head 65. The collecting trough 90 has a V-shaped cross-section and includes a fixed side 91 and a movable side 92 which is pivoted to the fixed side 91 by means of a hinge 93. The fixed side 91 is mounted on a vertical post 94 and is telescopic so that it is adjustable in height. A hydraulic cylinder 95 has an operating rod 951 connected to the movable side 92 of each trough 90. The movable side 92 is operated by the operating rod 951 to move between a closed position, as shown in FIG. 14, and an open position, as shown in FIG. 15.

Figure 1:
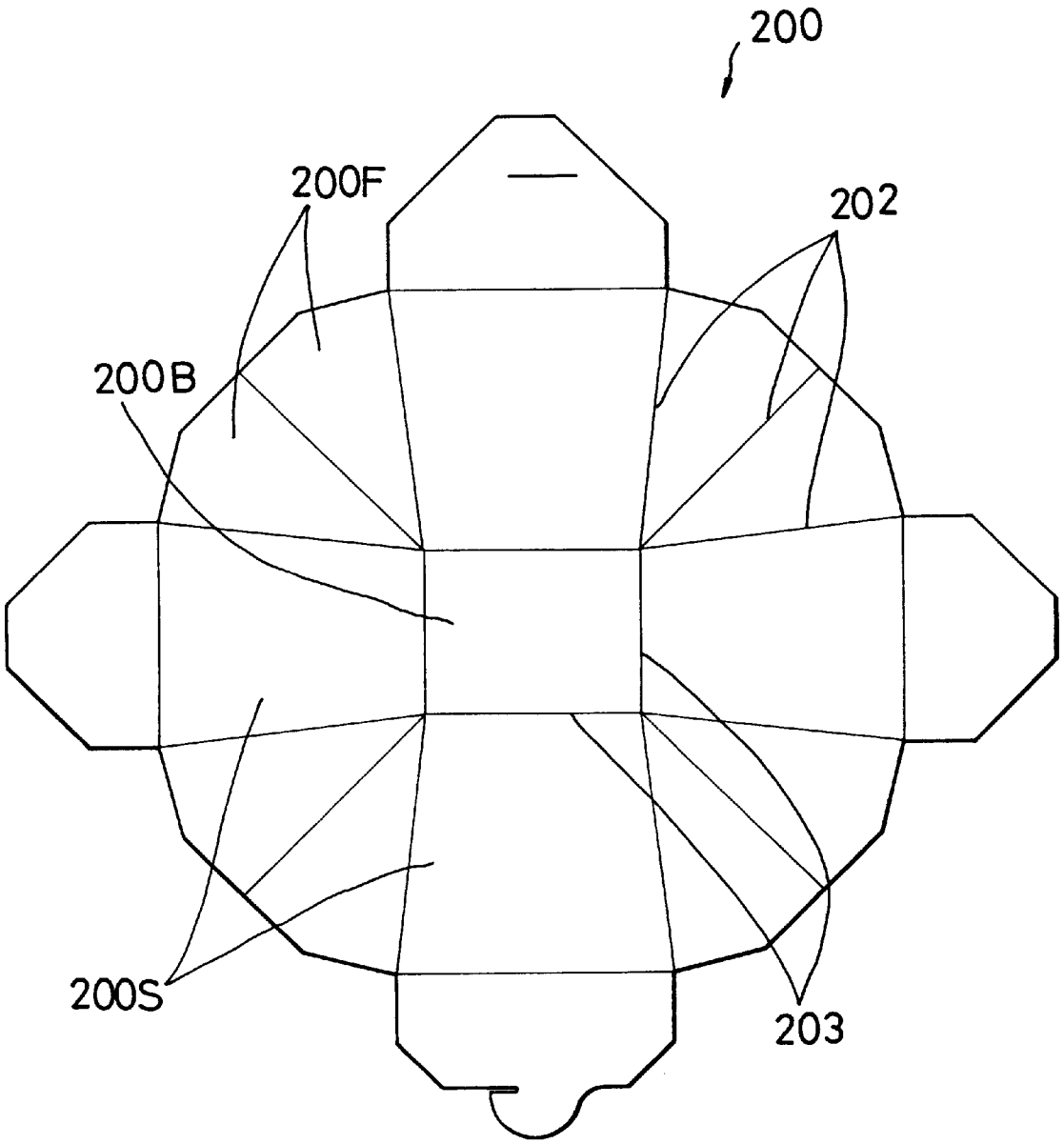
FIG.1 PRIOR ART
FIGS. 1 and 2 respectively show a conventional paper blank and a container formed by folding the conventional blank.
Figure 2:
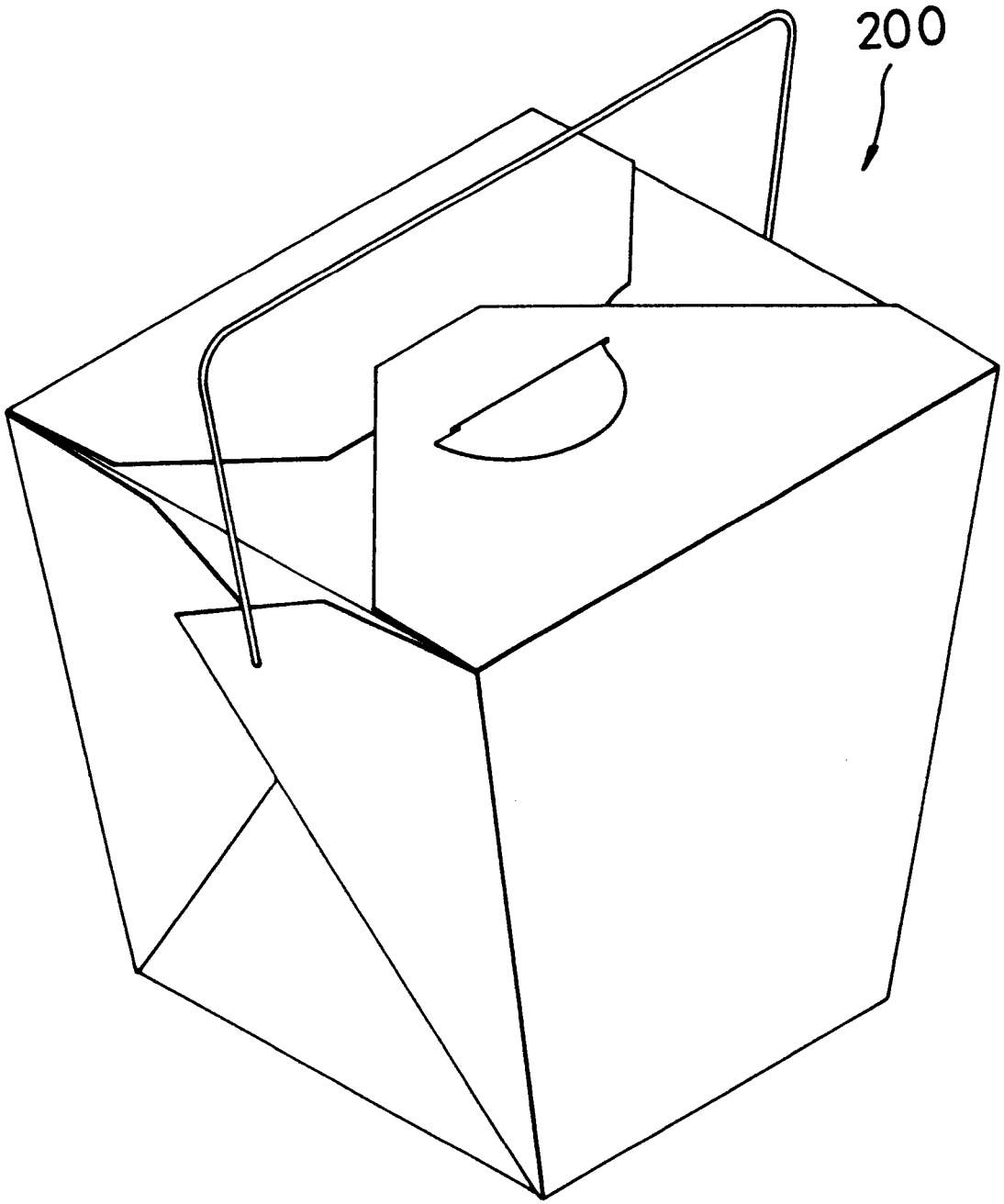
FIG.2 PRIOR ART

The apparatus of this embodiment is adapted to form a blank into a container having a closed bottom and four side walls. The blank is a tailored paper sheet which is provided with preformed fold lines as shown in FIG. 1 and which has two sides thereof formed with PE coating layers. In operation, blanks are placed on the left and right blank guide plate units 21 and 22. As shown in FIG. 3, when the hydraulic cylinder 61 is actuated to push one of the punch heads 65 to the left by means of the left piston rod 611, the left swing arm 75 is moved leftwards, thereby turning the left support shaft 74 clockwise and moving the left suction cups 77 leftwards. The suction cups 77 therefore deliver a blank taken from the blank guide plate unit 21 to the left upstanding blank feeding rail members 31. At this stage, the blank reaches the heating device 50. The blank is temporarily stopped by the stop rod 42 so as to be heated by the heating device 50. When the stop rod 42 is pulled backward, the blank pushing rod 85 turns downward and pushes downward the blank.

The blank pushing rod 85 of the blank pushing mechanism 80 is operated by the rotary shaft 81. As described hereinbefore, the weight member 84 is normally at the lower position shown in FIG. 4A due to its weight. When the swing arm 75 turns upward the driven rod 82 from the position shown in FIG. 4A, the weight member 84 is turned upward as shown in FIG. 4, and the rotary shaft 81 is turned counterclockwise. In this situation, the blank pushing rod 85 (FIG. 5) is turned upward to a non-pushing position. When the swing arm 75 moves away from the driven rod 82, the weight member 84 moves downward, and the blank pushing rod 85 turns downward and pushes the blank downward.

On the other hand, as the left punch head 65 is moved leftwards, the right punch head 65 is pulled back by the returning piston rod 612, and the right swing arm 75 is pulled leftwards. As a result, the right suction cups 77 are moved towards the blank guide plate unit 22 to pick up another blank from the blank guide plate unit 22.

When the blank in the left upstanding blank feeding rail members 31 finally rests on the blank resting seat 34, the blank is oriented in a vertical position between the punch head 65 and the blank forming device 67.

Figure 16:
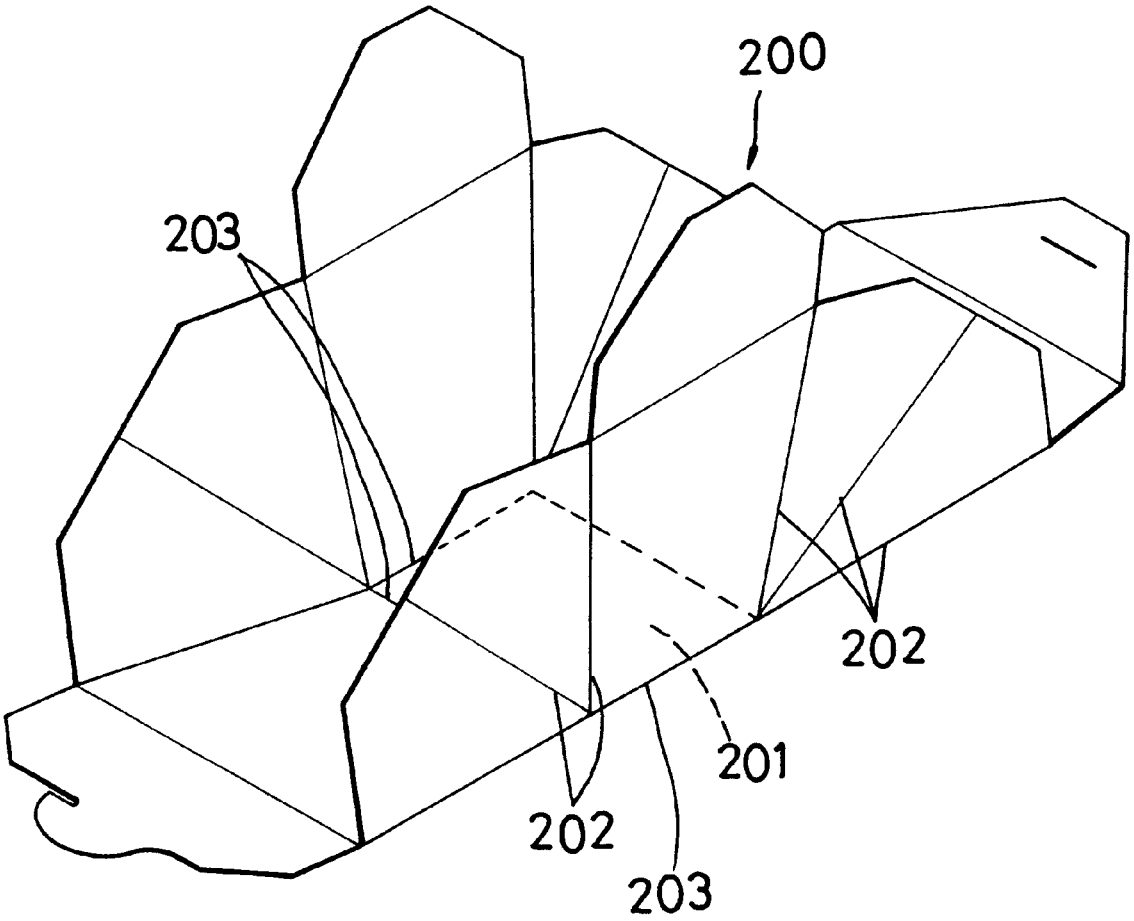
FIGS. 16 and 17 show how a blank is folded by the apparatus.
Figure 17:
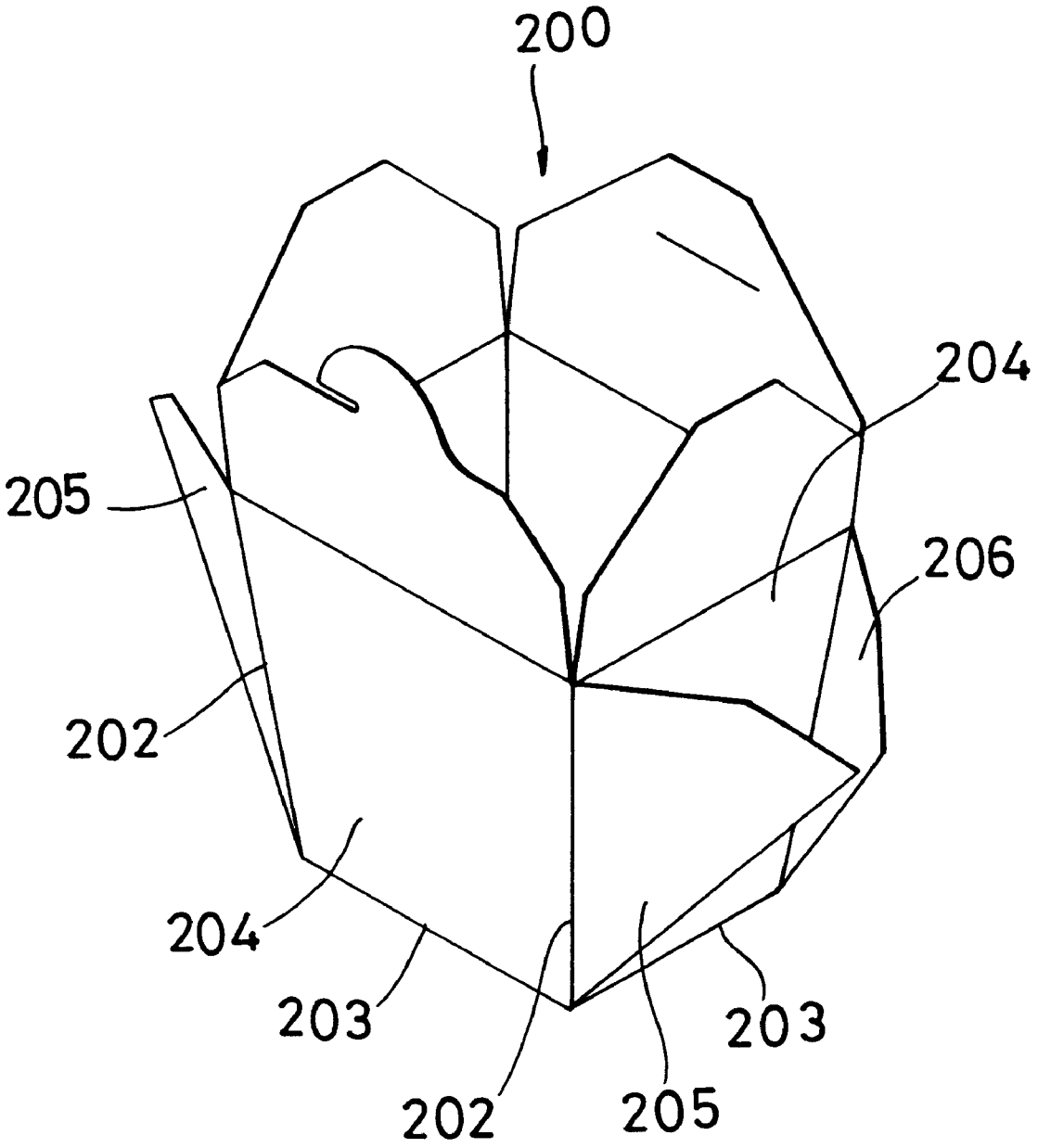

FIGS. 16 and 17 illustrate how a blank 200 is folded by the punch head 65 and the blank forming device 67. The blank 200 has a rectangular central region 201 defined by innermost fold lines 203. Outer fold lines 202 extend outwardly from four corners of the central region 201. The push pad 662 of the punch head 65 pushes the central region 201 during the forming operation. When the blank 200 is pushed into the forming passage 67*a*, the blank 200 first reaches the anterior folding ends 6711 of the first folding parts 671 and is therefore folded about two opposite innermost fold lines 203, as shown in FIG. 16. Subsequently, the blank 200 is moved between the posterior folding ends 6724, 6734 of the second folding parts 672, 673 and is therefore folded about the other two innermost fold line 203. In this situation, flaps 205, 206 project outwardly from four side walls 204. When the blank 200 reaches the first and second flap folding members 6721, 6731, the flaps 205 are first folded about the corresponding outer fold lines 202 toward the adjacent side walls 204 by the first camming edges 2722 of the first flap folding members 6721. The flaps 206 are subsequently folded over the flaps 205 by the second camming edges 6732 of the second flap folding members 6731. After the punch head 65 and the folded blank 200 pass through the press rollers 681, the press rollers 681 press the folded flaps 205 and 206 against the side walls 204. Since the blank 200 is pre-heated, the folded flaps 205, 206 are firmly bonded together by the heated and softened PE coating layers.

The left punch head 65 finally pushes each folded and formed product to the left product collecting trough 90 which is placed in a closed position, as shown in FIG. 14. When a certain number of the products are collected in the product collecting trough 90, the movable side 92 of the product collecting trough 90 is opened by the operating rod 951 of the hydraulic cylinder 95 to discharge the products.

The operations taking place at the right side of the apparatus corresponds to those performed at the left side as described hereinabove. However, the corresponding left and right side operations occur alternately because they are actuated by the double-acting hydraulic cylinder 61.

With this invention thus explained, it is apparent that numerous modifications and variations can be made without departing from the scope and spirit of this invention. It is therefore intended that this invention be limited only as indicated in the appended claims.

What I claim is:

1. An apparatus for forming a container from a blank which is provided with fold lines including interconnected innermost fold lines that confine a substantially central region of polygonal shape having at least four corners, and outer fold lines that extend outwardly from the corners, the blank being foldable about the innermost fold lines to form a closed bottom of the container and about the outer fold lines to form side walls and flaps which project outwardly of the side walls, the apparatus comprising:

a blank forming device which includes a forming passage of substantially polygonal cross-section and having at least four corners;

a blank feeding device disposed adjacent to the blank forming device and adapted to feed the blank towards the blank forming device in a first direction substantially parallel to the cross-section of the forming passage;

a punching mechanism disposed adjacent to the blank forming device, and having a punch head of polygonal cross-section, the punch head being capable of passing through the forming passage in a second direction transverse to the first direction, the punch head having a forward end formed with a polygonal push pad adapted to push the central region of the blank through the forming passage;

the blank forming device having a pair of opposing first folding parts and a pair of opposing second folding parts which confine the forming passage and which are adapted to fold the blank about the innermost fold lines when the punch head pushes the central region of the blank through the forming passage in the second direction, the first and second folding parts being spaced apart from each other adjacent to the corners of the forming passage, thereby forming discontinuations adjacent to the corners of the forming passage to permit the flaps to project outwardly of the forming passage;

the blank forming device further having a pair of spaced apart first flap folding members and a pair of spaced apart second flap folding members, all of which are disposed downstream of the first and second folding parts relative to the second direction of the punch head to confine a first downstream path for the punch head after the punch head exits the forming passage, the first flap folding members being disposed at two opposite sides of the first downstream path and adapted to fold two of the flaps about the corresponding outer fold lines, the second flap folding members also extending at the two opposite sides of the first downstream path, but projecting in opposite directions with respect to the first flap folding members, the second flap folding members being adapted to fold another two of the flaps subsequently.

2. The apparatus according to claim 1, wherein the second folding parts have posterior folding ends and the first folding parts have anterior folding ends, the anterior and posterior folding ends confining the forming passage and having a common plane that extends across the forming passage, the anterior folding ends projecting from the common plane in an opposite direction relative to the second direction so that the punch head reaches the posterior folding ends after passing the anterior folding ends, the anterior folding ends having opposite ends extending to the corners of the forming passage, the posterior folding ends having opposite ends spaced from the corners of the forming passage.

3. The apparatus according to claim 2, wherein the second folding parts further have integral projecting plate portions which project from the corresponding second folding parts in directions parallel to the second direction of the punch head and which extend on two other opposite sides of the first downstream path, the first and second flap folding members being formed as spaced apart parallel plates that project from the projecting plate portions, the first and second flap folding members having first and second camming edges which project from the projecting plate portions adjacent to the common plane, the first and second camming edges extending gradually away from the common plane when projecting away from the projecting plate portions, thereby forming first and second inclining angles respectively with the common plane, the second inclining angles being greater than the first inclining angles, whereby the first flap folding members perform a flap folding action prior to the folding action of the second flap folding members.

4. The apparatus according to claim 3, wherein the first and second flap folding members are substantially triangular and have distal apexes opposing the projecting plate portions, the distal apexes of the first flap folding members being formed spacedly from and upstream of the distal apexes of the second flap folding members.

5. The apparatus according to claim 1, wherein the blank forming device further comprises a forming and guiding frame which confines a rectangular hole, the first folding parts being mounted on two opposite sides of the forming and guiding frame to extend into the rectangular hole, the second folding parts being mounted on another two opposite sides of the forming and guiding frame to extend into the rectangular hole, the first and second folding parts confining the forming passage within the rectangular hole.

6. The apparatus according to claim 1, further comprising a press roller assembly disposed downstream of the first and second flap folding members relative to the second direction of the punch head, the press roller assembly including a pair of opposing press rollers which have substantially parallel roller shafts and which confine therebetween a second downstream path for the punch head, a pair of spacer bars disposed between the roller shafts at two sides of the second downstream path, and springs which bias the roller shafts to move in opposite directions toward the second downstream path, the punch head being tapered to facilitate passage between the press rollers.

7. The apparatus according to claim 2, wherein the first and second folding parts are arranged such that the common plane of the anterior and posterior folding ends is substantially vertical, the second direction of the punch head being substantially horizontal, wherein the blank feeding device includes a pair of spaced apart upstanding blank feeding rail members which are adapted to receive vertically the blank therebetween and to transfer the blank to the blank forming device by virtue of gravity, the upstanding blank feeding rail members having bottom end parts adjacent to the first and second folding parts, whereby, when the punch head moves through the bottom end parts of the upstanding blank feeding rail members into the forming passage, the blank is pushed into the forming passage.

8. The apparatus according to claim 7, further comprising a heating device disposed adjacent to the upstanding blank feeding rail members above the blank forming device and adapted to heat the blank before the blank is fed to the blank forming device, and a temporary stop mechanism provided adjacent to the upstanding blank feeding rail members and the heating device, and adapted to stop temporarily dropping of the blank along the upstanding blank feeding rails when the blank is heated by the heating device.

9. The apparatus according to claim 8, wherein the heating device includes a hot air blower.

10. The apparatus according to claim 8, further comprising a blank pushing member mounted adjacent to the upstanding blank feeding rail members above the temporary stop mechanism and adapted to push the blank downward after the blank is heated by the heating device.

11. The apparatus according to claim 7, further comprising a blank transporting mechanism which is disposed adjacent to the upstanding blank feeding rail members and which includes a suction cup adapted to suck the blank and to transfer the blank to the upstanding blank feeding rail members, and a suction cup holding arm which holds and moves the suction cup.

12. The apparatus according to claim 11, further comprising a power-operated drive mechanism which includes a hydraulic cylinder, the hydraulic cylinder being operatively connected to the punching mechanism and the suction cup holding arm.

* * * * *

UNITED STATES PATENT AND TRADEMARK OFFICE

CERTIFICATE OF CORRECTION

PATENT NO. : 6,053,854

DATED : April 25, 2000

INVENTOR(S) : Shun-Yu Yang

It is certified that error appears in the above-identified patent and that said Letters Patent is hereby corrected as shown below:

On The Title Page, under "Inventor", "Ynag" should be --Yang--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*